US005331536A

United States Patent [19]

Lane

[11] Patent Number: 5,331,536

[45] Date of Patent: Jul. 19, 1994

[54] LOW LEAKAGE HIGH CURRENT TRANSFORMER

[75] Inventor: William E. Lane, Melbourne Beach, Fla.

[73] Assignee: OPT Industries, Inc., Phillipsburg, N.J.

[21] Appl. No.: 972,150

[22] Filed: Nov. 5, 1992

[51] Int. Cl.[5] ..... H01F 27/28

[52] U.S. Cl. ..... 363/126; 363/144; 336/178; 336/183; 336/232

[58] Field of Search ..... 336/178, 183, 220, 221, 336/223, 232, 185; 363/126 O, 144

[56] References Cited

U.S. PATENT DOCUMENTS 2,485,599 10/1949 Halvorsen ..... 336/178
3,483,499 12/1969 Lugten ..... 336/183
4,584,551 4/1986 Burgher et al. ..... 336/61
4,977,491 12/1990 Domenget et al. ..... 336/232 X

*Primary Examiner*—Leo P. Picard
*Assistant Examiner*—L. Thomas
*Attorney, Agent, or Firm*—Arthur L. Lessler

[57] ABSTRACT

A transformer and associated rectifier for supplying low voltage (e.g. 5 volts), high current (e.g. 1,500 amperes) power to a load such as a supercomputer, with a high electrical conversion efficiency and a high volumetric efficiency. The primary winding comprises a number of disc-shaped coils which are spaced apart from each other by coaxial single turn secondary coil elements which are interleaved between the primary coils. A core having E-shaped parts has an inner portion extending through the primary and secondary coils and an outer portion forming two windows with the inner portion, so that the coils extend through the windows. A rectifier assembly is mounted directly to plates which support and act as terminals to the secondary coils.

7 Claims, 5 Drawing Sheets

LOW LEAKAGE HIGH CURRENT TRANSFORMER

BACKGROUND OF THE INVENTION

This invention relates to a transformer for use in high frequency switching power supplies, for supplying regulated low voltage high current power at high energy efficiency, which is especially suitable for, but not limited to, use in power supplies for high performance computers.

Supercomputers and other high performance computers typically require several kilowatts to several hundred or more kilowatts of power to be supplied at one or more low voltages in the range of 1.5 to 6.0 volts D.C.

Each required voltage requires a separate power supply. As power requirements increase, power supply units are operated in parallel, sharing the required load current for each voltage bus.

It is desirable to have these computers occupy as small a volume as possible, and that their power supplies also occupy a small volume (high power density) and have high energy efficiency to minimize heat loss in these power supply units.

Power supplies presently available are capable of meeting these requirements to only a limited extent; a primary limitation being the leakage inductance of the converter transformer. While the high frequency primary voltage may have a duty cycle (on time to total cycle time ratio) of 0.95, the duty cycle for energy transfer from the primary to the secondary winding of the converter transformer is limited by (i) the leakage inductances, (ii) the primary current, which is the load current reduced by the primary to secondary turns ratio, and (iii) the switching frequency. All other things being equal, an increase in switching frequency will further reduce the energy transfer duty cycle.

For a given output power, anything that reduces the energy transfer duty cycle requires a compensating reduction of the primary to secondary turns ratio. This reduction in turns ratio increases the RMS current in the primary circuits, increasing losses and reducing throughput efficiency.

Typical power supplies currently available use two to four or more converter transformers to achieve higher output power in a "single" power supply unit.[1] This approach generally requires a higher component count in the power portion of the units, which is likely to reduce reliability.

[1] Multiple converter transformer topologies typically are employed for units having an output of two kilowatts or more.

Accordingly, an object of the present invention is to provide an improved high energy efficiency transformer on a single permeable core structure having a low voltage high current secondary winding that will permit the implementation of higher power density, highly efficient power supply units.

SUMMARY OF THE INVENTION

As herein described, there is provided a low leakage high current transformer having a multicoil primary winding with a plurality of parallel spaced-apart coaxial coils, and a multicoil secondary winding with a plurality of parallel spaced-apart coil elements coaxial with the coils of the primary winding. The primary winding coils and the secondary winding coil elements are juxtaposed so as to alternate with each other. Primary terminal means is electrically connected to the primary winding coils and secondary terminal means is electrically connected to the secondary winding coils. A magnetically permeable core has an inner portion surrounded by the primary and secondary coils.

IN THE DRAWINGS

Figure 1:
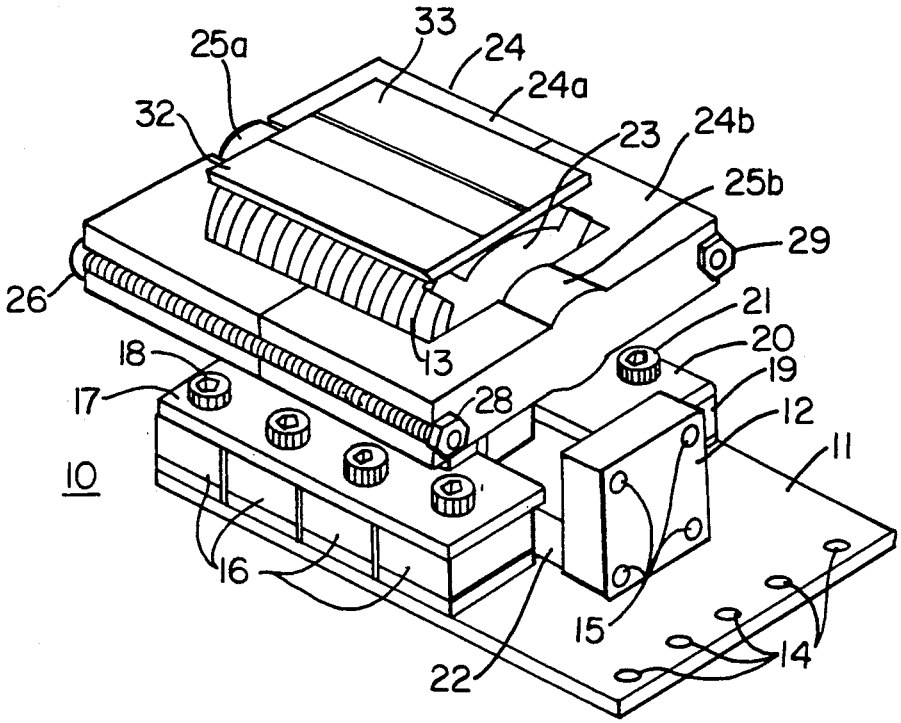
FIG. 1 is an isometric view of a transformer-rectifier assembly in accordance with a preferred embodiment of the present invention.
Figure 2:
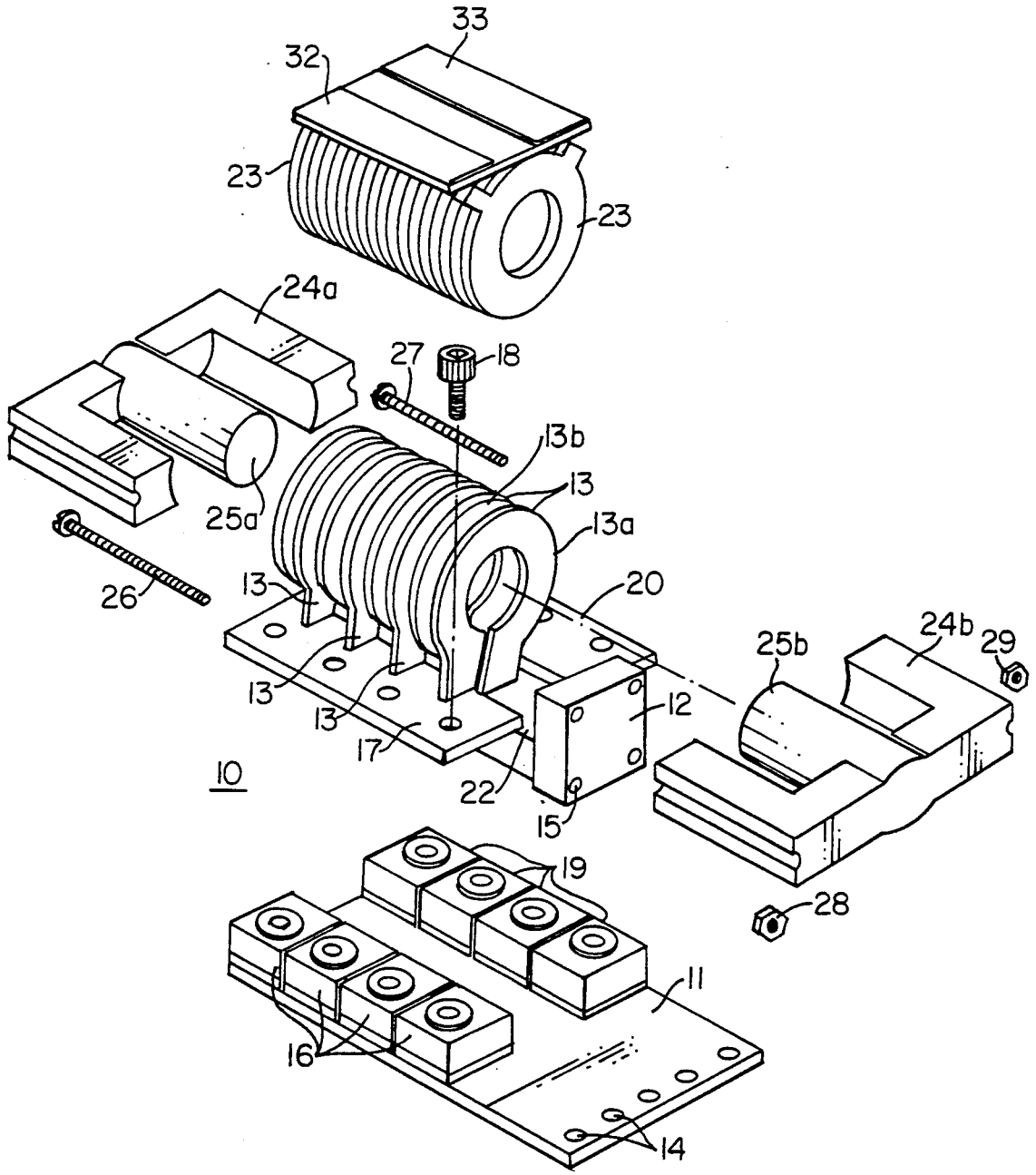
FIG. 2 is an exploded isometric view of the transformer-rectifier assembly shown in FIG. 1.
Figure 3:
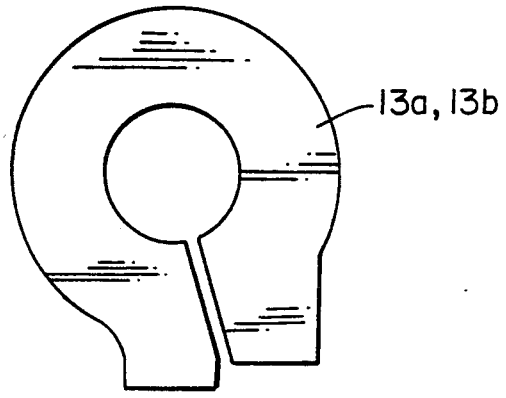
FIG. 3 is an elevation view of one of the single turn unitary metallic elements used in the secondary winding of the transformer shown in FIGS. 1 and 2.
Figure 6A:
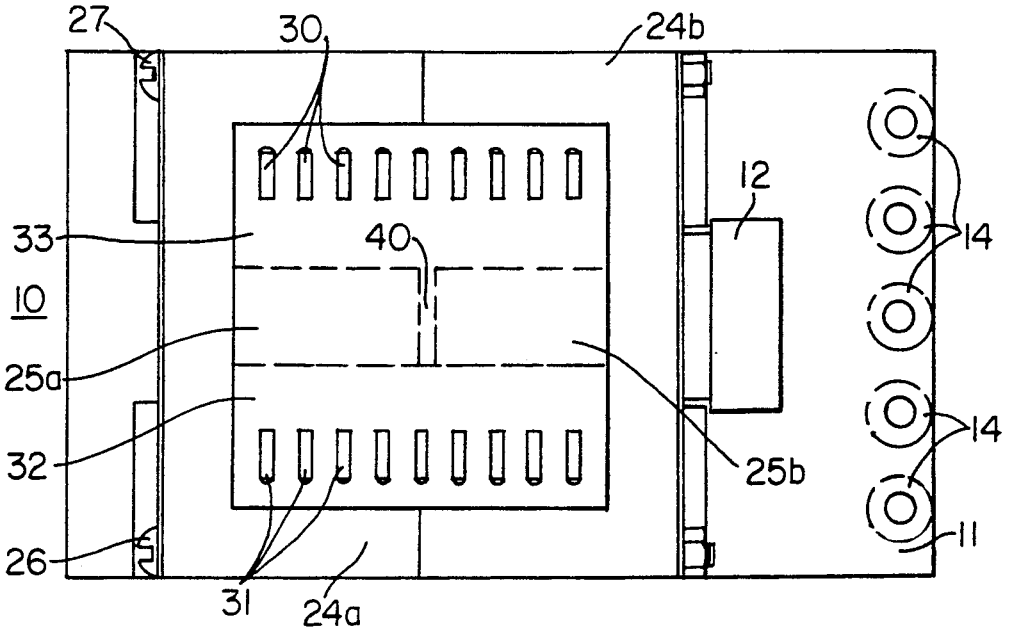
Figure 6B:
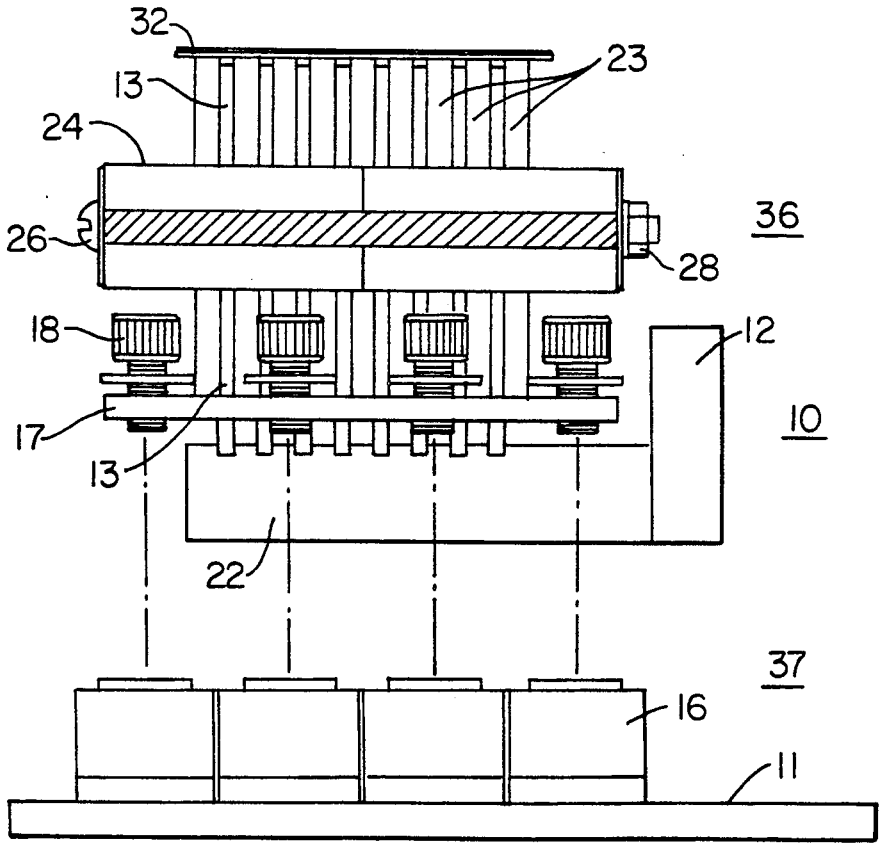
Figure 7:
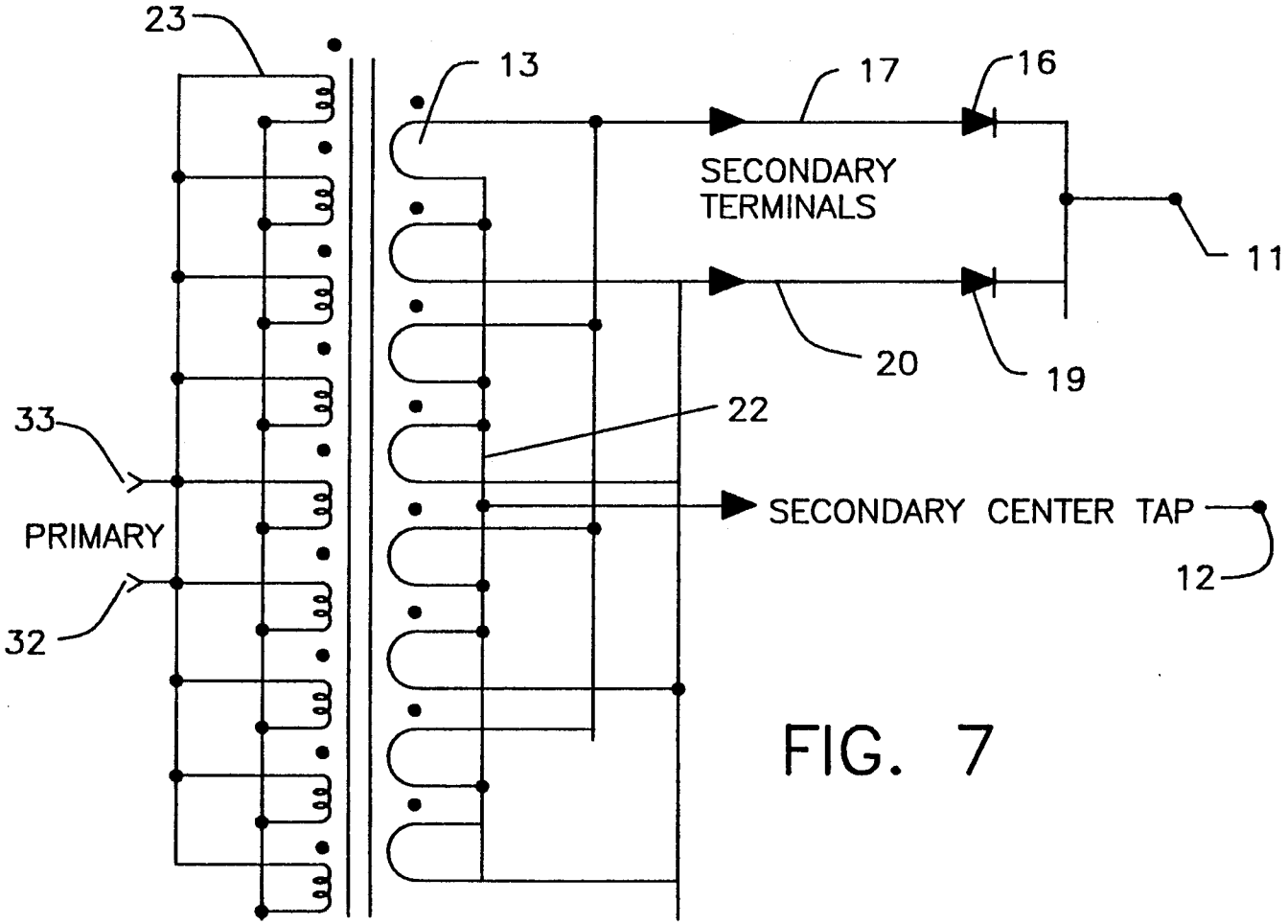

FIG. 6*a* is a top plan view of the transformer-rectifier assembly shown in FIGS. 1 and 2;

FIG. 6*b* is a partially exploded front elevation view of said transformer-rectifier assembly; and FIG. 7 is a schematic diagram of the aforementioned transformer-rectifier assembly.

DETAILED DESCRIPTION

The transformer-rectifier assembly 10 shown in FIG. 1 utilizes eight power rectifiers arranged in two banks, the rectifiers of each bank being connected in parallel with each other.

All of the rectifiers are mounted to a metallic output plate 11 which serves as one DC output terminal of the transformer-rectifier assembly 10, namely the positive terminal in the preferred embodiment.

A metallic block 12 mechanically and electrically connected to the center taps of the transformer secondary winding coils 13 serves as the other DC output terminal, i.e., the negative terminal, of the transformer-rectifier assembly 10.

The positive and negative DC output terminals 11 and 12 have screw holes 14 and 15 respectively for attachment of high current capacity connections to the voltage regulation portion of the power supply (not shown) of which the transformer-rectifier assembly 10 constitutes a part. It is preferred that the voltage regulator be a switching type regulation circuit operating at a frequency on the order of 100 KHz.

The rectifiers 16 which form one rectifier bank are shaped in the form of rectangular prisms with metallic upper and lower surfaces which act as their positive and negative terminals respectively. A secondary winding terminal plate 17 is electrically and mechanically secured to the positive terminals of the rectifiers 16 by means of screws 18.

The rectifiers 19 which constitute the other bank are similar to the rectifiers 16, and have their positive terminals electrically and mechanically connected to the secondary winding output terminal plate 20 by screws 21.

The secondary winding consists of four center-tapped coils 13. As best seen in FIG. 2, each of the coils 13 consists of a unitary generally planar metallic single turn element 13*a* having one end electrically and mechanically connected to the terminal plate 17 and the other end electrically and mechanically connected to the center tap bus 22 to which the center tap output terminal 12 is affixed; and a similar metallic single turn element 13*b* having one end mechanically and electrically secured to the terminal plate 20 and the other end mechanically and electrically connected to the center tap bus 22.

All of the single turn secondary winding elements 13*a* and 13*b* of all four secondary winding coils 13 are positioned in parallel with each other and with their center holes coaxial with each other, so that the secondary winding comprises eight single turn metallic disk-like plates 13*a*, 13*b* aligned with and spaced apart from each other.

The nine primary coils 23 which constitute the primary winding are disposed in juxtaposition and interleaved with the single turn members 13*a*, 13*b* which constitute the secondary winding, with the holes of the primary coils 23 coaxial with and having substantially the same diameter as the holes of the secondary winding elements 13*a*, 13*b*—so that the aligned coils of the primary winding and coil elements of the secondary winding form a cylindrical interior space for accepting the coaxially aligned cylindrical center parts 25*a*, 25*b* of the ferrite core 24, which consists of two E-shaped core elements 24*a* and 24*b*.

The cylindrical center parts 25*a*, 25*b* of the core elements 24*a*, 24*b* are coaxial with and of the same diameter as each other, and extend into the cylindrical interior space of the primary winding coils 23 and secondary winding coil elements 13*a*, 13*b*. The core central portions 25*a*, 25*b* are slightly shorter in length than the corresponding parallel leg parts of the core; so that while the leg parts of the core portions 24*a* and 24*b* abut each other, the central cylindrical core portions 25*a* and 25*b* have their free ends spaced slightly apart from each other to form an air gap 40 (FIG. 6*a*) which serves to prevent saturation of the ferrite core during operation of the transformer.

The outer lateral surfaces of the leg parts of the core portions 24*a*, 24*b* have longitudinal grooves for receiving screws 26 and 27 which are engaged by corresponding nuts 28 and 29 to retain the core portions 24*a* and 24*b* in place.

The primary and secondary coils extend through the two open spaces or windows between the center portion 25*a*, 25*b* of the core and the other portions of the core.

Figure 4:
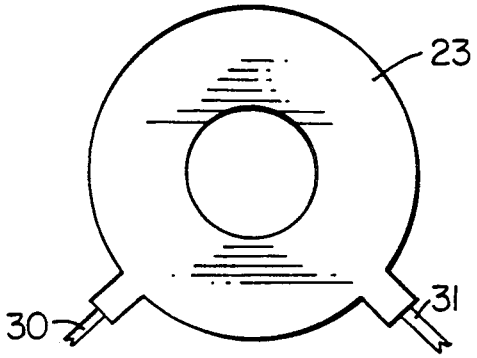
FIG. 4 is an elevation view of one of the coils of the primary winding of said transformer.
Figure 5:
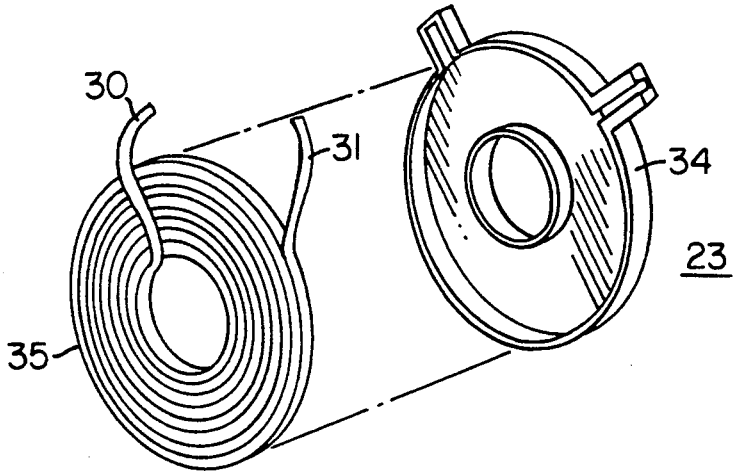
FIG. 5 is an exploded isometric view of the coil shown in FIG. 4.

As best seen in FIGS. 4 and 5, each of the primary coils 23 has terminal leads 30 and 31, with all of the leads 31 being connected to a primary terminal electrode 32 and all of the terminals 31 being connected to the other primary electrode 33—so that all the primary coils 23, which preferably have identical numbers of turns, are electrically connected in parallel with each other.

As seen in FIG. 5, each of the primary coils 23 comprises many turns of ribbon wire disposed in a plastic primary coil cup 34. The exposed surface of the ribbon wire coil 35 is covered with plastic, preferably by coating the exposed surface of the coil 35 (after the coil has been mounted in the cup 34) with plastic, and then grinding down the plastic to leave a thin covering over the coil 35.

The wire which constitutes the coil 35 is preferably conventional enamel-coated copper ribbon wire, the enamel serving to electrically insulate adjacent turns from each other.

The coil elements 13*a*, 13*b* of the secondary winding are preferably made of copper, silver brazed to the adjacent plates 12, 17 and 20, and subsequently plated with tin.

In FIG. 6*b* the transformer structure, indicated generally as 36, is shown separated from the rectifier structure, shown as 37, for purposes of clarity of illustration.

Thus the transformer 36 has a multicoil primary winding comprising nine disc-shaped primary winding coils 23 electrically connected in parallel, each of which has two opposed substantially parallel substantially planar surfaces. The nine primary winding coils are intermeshed with the eight identical secondary winding single turn elements 13*a*, 13*b* which form the four center-tapped secondary winding coils 13 which are electrically connected in parallel with each other.

This arrangement places the primary winding extremely close to the secondary winding, so that leakage inductance of the transformer 36 is very low. In the preferred embodiment which has been described, the transformer has a self-resonant frequency on the order of 3.5 MHz, far above the preferred 100 KHz operating frequency of the associated switching regulator; so that the resonance of the transformer does not adversely affect the operation of the power supply.

The transformer 36 is capable of delivering a secondary voltage of 5 volts rms at a current of 1500 amperes rms with an energy efficiency greater than 95%.

When the transformer-rectifier assembly 10 of the preferred embodiment was utilized in a switching regular power supply with pulse width modulation at a 95% duty cycle, the power supply delivered 5.2 volts DC at 1500 amperes with an overall energy efficiency of approximately 85%, at a 100 KHz switching rate. This was accomplished with a transformer-rectifier assembly of very small size, FIG. 1 being drawn to approximately two-thirds of full scale.

Cooling of the transformer-rectifier assembly 10 may be provided by immersing the entire assembly in a suitable inert coolant, or by attaching the plate 11 to a suitable air-cooled heat sink.

The transformer 36 may be readily scaled to provide larger or smaller output currents, preferably by varying the number of primary coils and secondary coil elements accordingly.

The transformer 36 is not limited to single turn secondary winding coils. If desired, the single turn elements 13*a*, 13*b* may be interconnected so as to provide one or more multi-turn secondary winding coils.

The arrangement described herein provides very direct connections to the rectifier elements and thus minimizes the contribution of the rectifier banks to circuit inductance, so that the high self-resonant frequency of the transformer is not impaired.

I claim:

1. A low leakage high current transformer comprising:

a multicoil primary winding, each coil of said primary winding having two opposed substantially parallel substantially planar major surfaces, said primary winding coils being coaxially disposed adjacent and spaced apart from each other with the major surfaces of each coil being substantially parallel to the major surfaces of the other coils, said primary winding coils being electrically connected in parallel with each other;

a multicoil secondary winding, each coil of said secondary winding having two adjacent single turn coil elements, each of said elements having two opposed substantially parallel substantially planar major surfaces, said secondary coil elements being coaxially disposed adjacent and spaced apart from each other with the major surfaces of each secondary coil element being substantially parallel to the major surfaces of the other secondary coil elements;

the primary winding coils being intermeshed and coaxial with the secondary winding coil elements, so that the primary winding coils and the secondary winding coil elements are alternately juxtaposed on the axis thereof;

primary terminal means electrically connected to said primary winding coils;

secondary terminal means electrically connected to said secondary winding coils, and including a secondary center tap terminal electrically connected to adjacent ends of the elements of each secondary winding coil; and a magnetically permeable core having an inner portion extending inside each of said coils and an outer portion surrounding said inner portion and forming two windows therewith, said coils extending through each of said windows.

2. The transformer according to claim 1, wherein each of said primary winding coils comprises ribbon wire coated with an insulating layer.

3. The transformer according to claim 1, wherein the inner portion of said core has an air gap therein.

4. The transformer according to claim 1, wherein the inner and outer diameters of all of said coils are approximately the same.

5. A low leakage high current transformer comprising:

a multicoil primary winding, each coil of said primary winding having two opposed substantially parallel substantially planar major surfaces, said primary winding coils being coaxially disposed adjacent and spaced apart from each other with the major surfaces of each coil being substantially parallel to the major surfaces of the other coils, said primary winding coils being electrically connected in parallel with each other;

a multicoil secondary winding, each coil of said secondary winding comprising at least on element, each element having two opposed substantially parallel substantially planar major surfaces, said secondary coil elements being coaxially disposed adjacent and spaced apart from each other with the major surfaces of each secondary coil element being substantially parallel to the major surfaces of the other secondary coil elements;

the primary winding coils being intermeshed and coaxial with the secondary winding coil elements, so that the primary winding coils and the secondary winding coil elements are alternately juxtaposed on the axis thereof;

primary terminal means electrically connected to said primary winding coils;

secondary terminal means electrically connected to said secondary winding coils;

a magnetically permeable core having an inner portion extending inside each of said coils and an outer portion surrounding said inner portion and forming two windows therewith, said coils extending through each of said windows;

a secondary terminal output plate; and a plurality of semiconductor rectifiers each having opposed substantially parallel terminal surfaces, one terminal surface of each rectifier being electrically and mechanically secured to said output plate and the other terminal surface thereof being electrically connected to an end of a corresponding secondary winding coil.

6. A low leakage high current transformer comprising:

a multicoil primary winding, each coil of said primary winding comprising a multiplicity of turns and having two opposed substantially parallel substantially planar major surfaces, said primary winding coils being coaxially disposed adjacent and spaced apart from each other with the major surfaces of each coil being substantially parallel to the major surfaces of the other coils, a multicoil secondary winding, each coil of said secondary winding comprising at least one metallic disk-like plate, said secondary winding plates being coaxially disposed adjacent and spaced apart from each other with the major surfaces of each plate being substantially parallel to the major surfaces of the other secondary winding plates;

the primary winding coils being intermeshed and coaxial with the secondary winding plates, so that the primary winding coils and the secondary winding plates are alternately juxtaposed on the axis thereof;

primary terminal means electrically connected to said primary winding coils;

secondary terminal means electrically connected to said secondary winding coils, said secondary terminal means comprising at least two metallic secondary terminal plates, each of said secondary winding plates having one end mechanically and electrically secured to one of said secondary terminal plates, and another end mechanically and electrically secured to another of said secondary terminal plates; and a magnetically permeable core having an inner portion extending inside each of said coils and an outer portion surrounding said inner portion and forming two windows therewith, said coils extending through each of said windows.

7. The transfer according to claim 6, wherein said secondary terminal means comprises three metallic secondary terminal plates, one of which terminal plates constitutes a center tap bus, each coil of said secondary winding comprising two single turn metallic disk-like plates, one end of each half turn plate being mechanically and electrically connected to said center tap bus.

* * * * *